US005341126A

United States Patent [19]

Boykin

[11] Patent Number: 5,341,126

[45] Date of Patent: Aug. 23, 1994

[54] SELECTIVE EXIT CONTROL SYSTEM

[76] Inventor: Roger O. Boykin, 249 Symphony La., Shreveport, La. 71105

[21] Appl. No.: 814,920

[22] Filed: Dec. 26, 1991

[51] Int. Cl.[5] ..... G08B 23/00

[52] U.S. Cl. ..... 340/573; 324/234; 340/551

[58] Field of Search ..... 340/573, 551; 324/234–235; 200/86.5

[56] References Cited

U.S. PATENT DOCUMENTS

| | | | |
|---|---|---|---|
| 3,950,696 | 4/1976 | Miller et al. | 324/234 |
| 4,524,932 | 6/1985 | Bodziak | 324/235 X |
| 4,555,696 | 11/1985 | Brown | 340/551 |
| 4,684,933 | 8/1987 | Dill | 340/573 X |
| 4,853,692 | 8/1989 | Wolk et al. | 340/573 |
| 4,970,463 | 11/1990 | Wolf et al. | 324/235 X |
| 5,039,981 | 8/1991 | Rodriguez | 340/551 |
| 5,093,617 | 3/1992 | Murata | 324/235 |
| 5,121,105 | 6/1992 | Aittoniemi | 340/551 X |

FOREIGN PATENT DOCUMENTS

| | | | |
|---|---|---|---|
| 237386 | 11/1985 | Japan | 340/551 |
| 8703119 | 5/1987 | World Int. Prop. O. | 340/551 |

*Primary Examiner*—Thomas Mullen
*Attorney, Agent, or Firm*—John M. Harrison

[57] ABSTRACT

A control system for determining when one or more persons exit a designated environment or location. The control system includes a magnetic cuff or anklet attached to the ankle of a person in the location or environment and an electronic detection system located in a threshold detector unit mounted in the floor of the location or environment. The electronic detector system is characterized by an amplified "Hall Effect" integrated circuit (IC) which is designed to detect movement of the magnetic cuff or anklet through a detection zone up to about 10 inches above the threshold plate. Various alarm apparatus may be connected to the "Hall Effect" IC circuit to announce movement of the person upon which the magnetic cuff or anklet is attached through the entrance way.

16 Claims, 2 Drawing Sheets

FIG. 5

FIG. 1
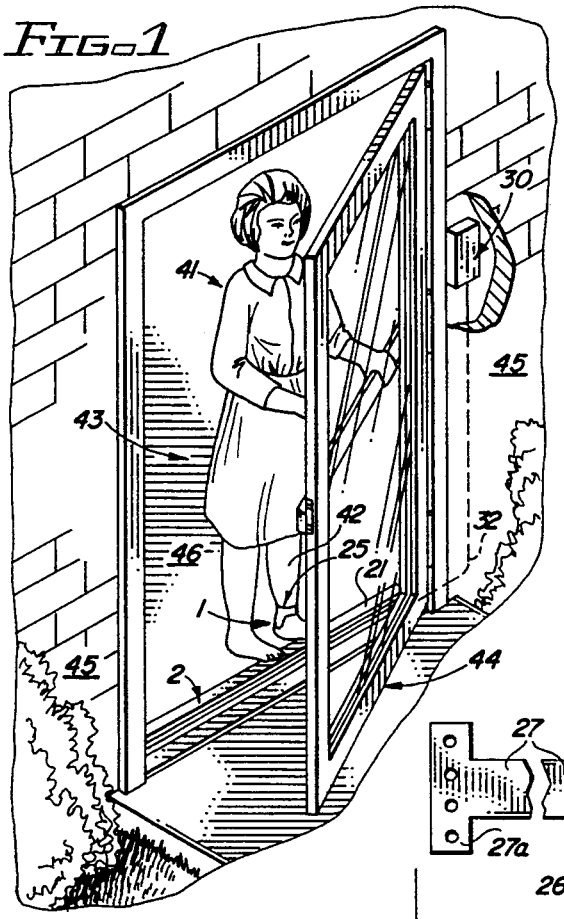
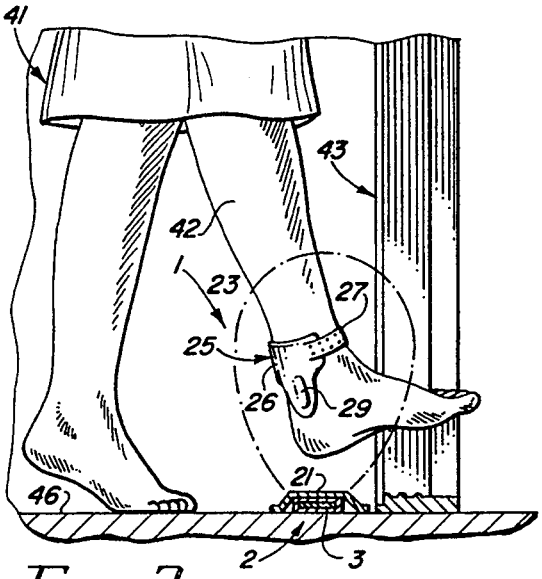
FIG. 3
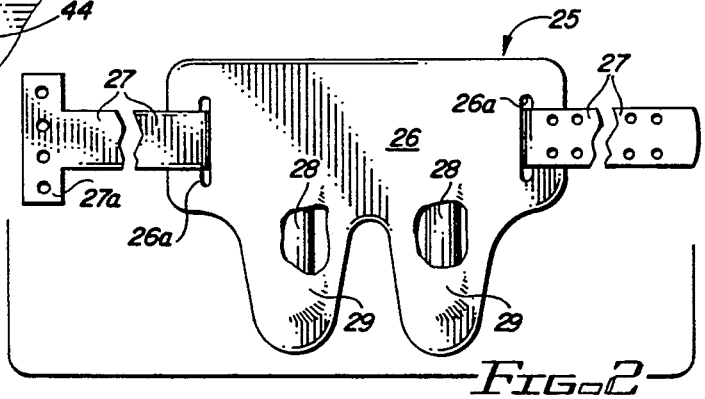
FIG. 2
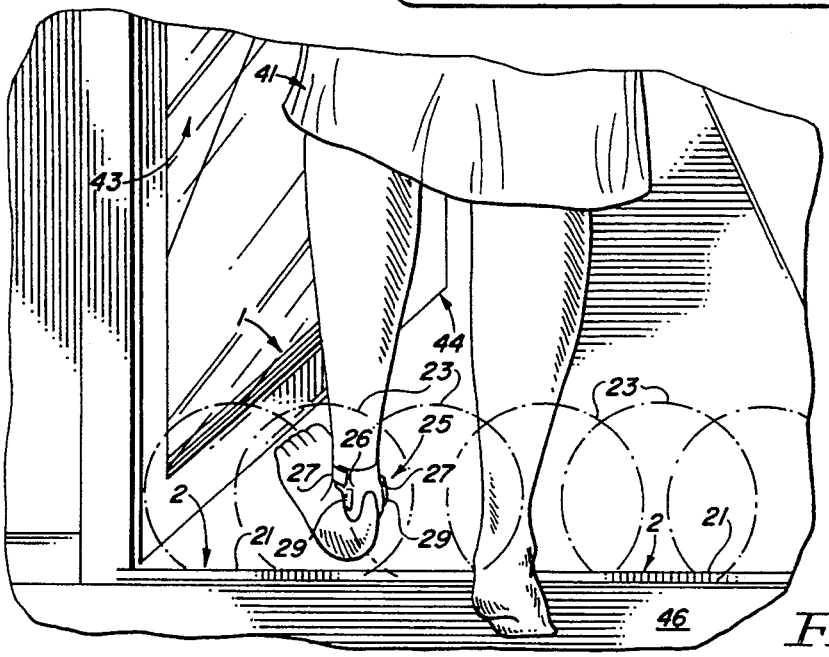
FIG. 4

SELECTIVE EXIT CONTROL SYSTEM

BACKGROUND OF THE INVENTION

1. Field of the Invention

In certain medical and security related environments it is desirable to create a signal when certain persons exit a designated environment. For example, in a nursing home environment it is desirable that a signal be created if a selected patient or resident exits the nursing home. In a similar manner, it is desirable that a signal be created if a person exits their bed under circumstances where such exit would be deemed an unsafe or undesirable activity.

Most of the existing detection systems utilize radio frequency (RF) techniques wherein the object (person to be detected) is fitted with a small RF transmitter and the control unit (or detection device) is installed adjacent to a monitored passageway such as a building exit. These systems detect the monitored person by reception and recognition of the unique frequency associated with the person, to the exclusion of all other persons not emitting this pattern. The complexity of these systems varys from the non-sophisticated to the very complex pattern (or signal analysis) type. These systems may be very expensive, depending upon the degree of complexity, which is normally related to the desire of reducing the occurrence of false alarms. Many of these systems utilize batteries in an RF transmitter which is fitted to the patient, either on the wrist or at another location, which batteries must be periodically replaced. In some cases, the entire transmitter assembly must be replaced, thereby leading to fairly expensive recurring costs in the use of the system and many systems utilize detection elements such as magnets in both shoes of the person monitored.

Many such systems are currently available on the market and typical of these is the "Code Alert" wanderer monitoring system developed by R. F. Technologies, Inc., of Milwaukee, Wis. A similar system known as "Wander Guard" selective alert system includes a signalling device worn by the wanderer and a receiver mounted in the door or recessed in the wall of a structure. If a wanderer walks through the monitored area, a distinctive beeper alerts nursing staff or security to the movement of the patient or resident. The "Wander Guard" system is developed by Senior Technologies, Inc., of Lincoln, Nebr. A similar system is "Smart Lock" which is designed to lock an exit only when approached by a monitored resident. When the resident retreats from the door, the "Smart Lock" control quietly returns the door to its unlocked state. The "Smart Lock" system is developed by McKerly Company of Concord, N.H.

Many such detectors are the subject of United States patents, typical of which is the "Passageway Selective Detector Mechanism and System" detailed in U.S. Pat. No. 4,555,696, dated Nov. 26, 1985, to Donald G. Brown. The passageway selector detector mechanism and system includes a mat which is positioned within a passageway such as a doorway, gate or the like. Embedded within the mat are magnetically operable electric switches which are electrically connected to an alarm or a signal member and to a source of electrical energy. Thus, when any of the switches is operated, the alarm or signal members are energized. The mechanism and system includes magnetic elements located in the shoes of selected personnel for operation of at least one of the electric switches as the selective personnel travels over the mat. The magnetic element may include an inner sole within the shoes of the selected personnel to actuate an electric switch, which magnetic element actuates the alarm or signal member as the selective personnel steps upon the mat. The magnetic element may also include a magnetic member carried by a wheelchair in which the selective personnel travels and which actuates an electric switch, which energizes an alarm or signal member as the selective personnel travels over the mat in the wheelchair. U.S. Pat. No. 4,945,340, dated Jul. 31, 1990, to Henry L. Brille, details a "Tamper-Resistant Magnetic Security System". The security system is adapted for use in a physical security monitoring environment and includes a switch unit having a common conductor a guard conductor and at least three switches. Each of the switches incorporates a deactivated condition and an activated condition and each is adapted to be placed in its activated condition in response to a magnetic field of predetermined magnetic flux. The switch unit also includes a logic circuit electrically interconnecting the switches and the common and guard conductors, the logic circuit completing a series circuit between the common conductor and the guard conductor whenever at least two predetermined, but not all, switches are in magnetically actuated condition. As associated actuated unit includes at least two permanent magnets and provides discreet magnetic fields of predetermined flux density and positioned to individually activate the two or more predetermined switches and complete the series circuit between the common conductor and the guard conductor when the actuator unit is located in predetermined juxtaposition with respect to the sensor unit. A "Frequency Divider With Single Resonant Circuit and Use Thereof As a Transponder in a Presence Detection System" is detailed in U.S. Pat. No. 4,654,641, dated Mar. 31, 1987, to L. G. Ferguson, et al. The device includes a portable frequency divider which includes a single resonant circuit including a nonlinear conductor having a core made of amorphous magnetic material and a capacitance connected in series with the conductor, to define a resonant circuit that detects electromagnetic radiation at a first predetermined frequency and responds to the detection by transmitting electromagnetic radiation at a second frequency which is a subharmonic of the first frequency. U.S. Pat. No. 4,663,612, dated May 5, 1987, to E. Majia, et al, details a "Pattern-Comparing Security Tag Detection System". The security apparatus is designed to detect a security tag which is hidden in an article to be detected. The digitized wave shape of a tag signature signal is preferably obtained by distortion of an oscillating magnetic field (whereby the distortion signal being detected constitutes a signature signal) and is compared with a stored digital representative of a signature signal and an alarm enabling signal is generated in the event of correlation in a predetermined number of times in a predetermined time period. The storage signal is modified by the specific factors and characteristics of the apparatus, as well as environmental factors. U.S. Pat. No. 4,882,569, dated Nov. 21, 1989, to S. Dey, covers a "De-Activatable Frequency-Dividing-Transponder Tag". Detailed is a presence-detection-system tag in which a frequency-dividing transponder may be decisively deactivated notwithstanding the intensity of the ambient magnetic field. The tag includes a frequency-dividing transponder, including an active strip of magnetic material which, when magnetically biased to be within a predetermined magnetic field intensity range, responds to excitation by electromagnetic radiation of a first predetermined frequency by radiating electromagnetic radiation of a second predetermined frequency that is, a frequency-divided quotient of the first predetermined frequency. A first biased strip of magnetic material is disposed relative to the active strip of magnetic material for biasing the active strip of magnetic material within the predetermined magnetic field intensity range, only when the first biased strip is magnetized. Further included is a second biased strip of magnetic material disposed relative to the active strip of magnetic material for further biasing the active strip to be outside of the predetermined magnetic field intensity range and thereby preventing the active strip of magnetic material from radiating electromagnetic radiation of the second predetermined frequency in response to excitation by electromagnetic radiation of the first predetermined frequency when the first and second bias strips of magnetic material are both magnetized. A coded tag includes such two active strips having different magnetomechanical resonant frequencies and either tag may be detected in a presence detection system that includes means for transmitting an electromagnetic radiation signal of a first predetermined frequency into a surveillance zone and means for detecting electromagnetic radiation of the second predetermined frequency within the surveillance zone. The system further includes a magnetizer for magnetizing the second bias strip to deactivate the frequency-dividing transponder of the tag.

One of the problems which exists with existing patient monitoring and control systems is the problem of properly and efficiently fitting the patient or the patients' shoes with a desirable transmitter or other detection device which cannot be removed. For example, in a nursing home or hospital environment, certain residents or patients may not have a cognitive awareness of or concern for their attire. Most of the people in this category suffer from some type of dementia such as Alzheimer's, or in some cases, brain injury. Consequently, the residents or patients cannot be relied upon to wear the required devices or their shoes when they attempt an unauthorized exit from their room in the hospital, nursing home or other facility.

The "Hall Effect" integrated circuit (IC) offers promise for use in a detection system, since it is capable of sensing a magnetic field. Specifically, this device detects motion, position or change in the field strength of an electromagnet, permanent magnet or a ferromagnetic material with an applied magnetic bias. However, manufacturers specifications normally limit the useful sensitivity or range of "Hall Effect" IC switches and sensors to an extremely small distance of about ½ of an inch. With increased complexity and the use of strong magnetic assemblies, this sensitivity can be extended to about 1 inch. In contrast, the selective exit control system of this invention is capable of detecting human movement by actually detecting the movement of magnetic material in a manner which yields a sensitivity of up to ten times the normal sensitivity of the conventional "Hall Effect" IC switch. This increased sensitivity is absolutely necessary to the efficacy of the invention, since the passage of a person's foot over a floor-mounted object such as a threshold or the like, is variable in terms of linear clearance and averages from about two to three inches. It should be noted that increases in "gain" and increases in "sensitivity" from an electronic standpoint are not synonomous. Increases in "gain" are relatively easy to obtain, while even minor increases in sensitivity are extremely difficult to achieve. The sensitivity of solid state "Hall Effect" IC switches is generally controlled by the manufacturer. This tends to limit use of these switches to standard "textbook" applications. When these devices "see" a state of minimum magnetic field strength they will switch in a predictable manner.

Accordingly, the first important component of the selective exit control system of this invention is use of a "Hall Effect" IC sensor which has a continuously variable output related to the magnetic field strength that it "sees". In this regard, it performs an analog rather than a digital switch function. However, the "Hall Effect" IC sensor can "see" a very small change in magnetic field strength, but the resulting signal is of such small magnitude as to be virtually unusable.

The second important component of the invention is based on the understanding that the "unusable" signal generated by the "Hall Effect" IC sensor can be essentially doubled, that is, increased in sensitivity, by using two "Hall Effect" IC sensors instead of one, and configuring them in an electronic "push-pull" arrangement, such that one output is positive as the other output is negative for the same magnetic stimulus. Each of these "Hall Effect" IC outputs is connected to one of two "stage one" operational amplifier (buffer-amplifier) inputs. In this manner, the "stage 1" buffer/amplifier resistors can be conventionally selected to provide a selected "gain".

The third important component of the invention is the use of a pair of mutually reinforcing, permanent magnet assemblies which include exceptionally strong "rare earth" magnets that are both oriented to simultaneously increase and broaden the magnetic field strength in a preferred direction, in this case, downwardly. These magnets assist in converting the low, "unusable" signal into levels which can be further processed in a useable manner according to the invention.

The fourth important component of the invention includes implementation of a comparator circuit. The normal use of comparators requires two separate inputs, one of which is a fixed reference and the other a variable input, such that if the variable input goes slightly above the fixed reference, the comparator will change its output state. This standard design was unacceptable for use in the selective exit control system of this invention because the absolute difference between the two input voltages was very small. Accordingly, any drift or slight deviation in the input over time would cause the results to lack stability and repeatability. The solution was to design the circuit such that the fixed reference is not a fixed voltage level, but is derived from the variable input.

The fifth important aspect of the invention is the selection of component values in the electronic arrangement such that the circuit allows "finger-printing" or signature analysis of the wave-shape characteristics insofar as they are representative of expected or actual human movement. Since the two comparator inputs are derived from the same point, signals which are too fast or too slow are purposely ignored by the detection circuit. This discrimination against signals which appear not to be representative of human movement is provided by the unique arrangement and choice of component values in the invention.

Accordingly, it is an object of this invention to provide a non-mechanical, electronic and magnetic detection system which creates a signal when a selected person wearing a single, removable or non-removable, fitted cuff or anklet containing one or more magnetic elements, walks through a detection zone.

Another object of this invention is to provide an electronic system for detecting wandering patients or residents by utilizing a combination of strong "rare earth" magnets fitted on an anklet or cuff in non-removable fashion and effecting an increased field strength, such that solid state "Hall Effect" magnetic sensors, using special techniques which enhance detection sensitivity, may detect and create a signal over a distance of up to about 10 times that normally associated with magnetic sensing devices.

Still another object of this invention is to provide a non-mechanical selective exit control system which includes a non-battery operated magnetic anklet designed for mounting on the ankle of a patient or resident and fitted with a pair of spaced rare earth magnets disposed so as to increase the field strength of the magnets and further including a "Hall Effect" integrated circuit (IC) detection system which is enhanced electronically and fitted within a threshold strip to facilitate detection of the magnetic anklet of the patient or resident when he or she steps through the detection zone generated by the enhanced "Hall Effect" IC sensors.

SUMMARY OF THE INVENTION

These and other objects of the invention are provided in a non-mechanical selective exit control system for monitoring the wandering of patients in hospitals and residents of nursing homes, as well as persons in other controlled environments, which control system includes, in a preferred embodiment, a pair of rare earth bar magnets spaced along the plane of the leg in an anklet attached to the ankle of the resident or patient and oriented such that the magnetic field of the magnets is enhanced and extended, along with a "Hall Effect" IC magnetic detection system mounted in the threshold or door area of the hospital, nursing home or other environment, which "Hall Effect" IC detection system is electronically enhanced to detect the magnetic field generated by the magnets in the anklet at a height of up to about 10 inches above the threshold when the patient or resident crosses the threshold. The selective exit control system requires no batteries or accessories such as shoes for operation.

BRIEF DESCRIPTION OF THE DRAWINGS

The invention will be better understood by reference to the accompanying drawings, wherein:

FIG. 1 is a perspective view of a typical application of the selective exit control system of this invention;

FIG. 2 is a front view of a typical magnetic anklet assembly or cuff containing a pair of magnets for disposition on a user's lower leg or ankle;

FIG. 3 is a side view of the magnetic anklet assembly mounted on the ankle of a user in functional configuration;

FIG. 4 is a rear view of the magnetic anklet assembly illustrated in FIG. 4;

DESCRIPTION OF THE PREFERRED EMBODIMENTS

Figure 5:
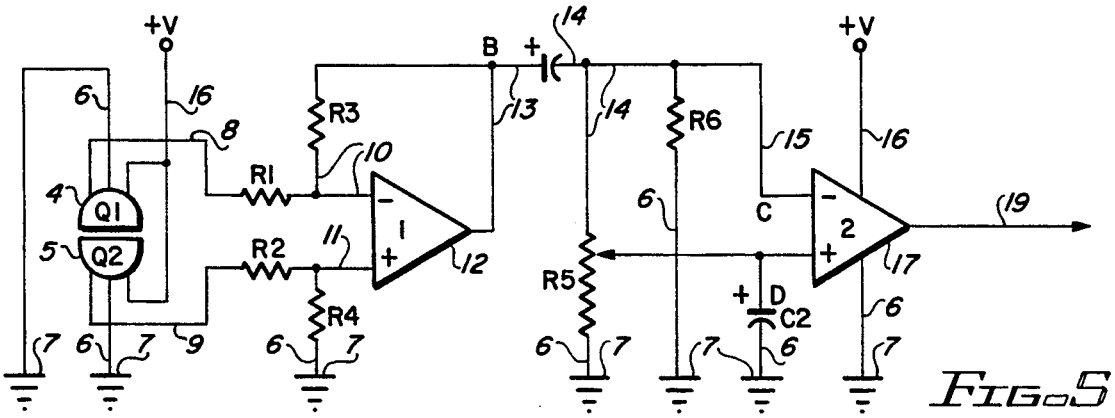
FIG. 5 is a schematic of an enhanced sensitivity "Hall Effect" IC circuit board used to detect a magnetic field.

Referring initially to FIGS. 1-4 of the drawings, the selective exit control system of this invention is generally illustrated by reference numeral 1. The selective exit control system 1 is characterized by a threshold detection unit 2 which is mounted in the doorway 43, closed by a door 44, as illustrated in FIG. 1. The threshold detection unit 2 is typically protected and enclosed by a threshold cover 21 and is situated such that a person 41 must step over the threshold detection unit 2 in order to exit the doorway 43. This stepping function is illustrated by the raised leg 42 of the person 41, wherein the foot is poised over the threshold detection unit 2 for purposes which will be hereinafter further described. The other foot of the person 41 is supported by the floor 46, upon which the threshold detection unit 2 rests, as further illustrated in FIGS. 1, 3 and 4 of the drawing.

Figure 6:
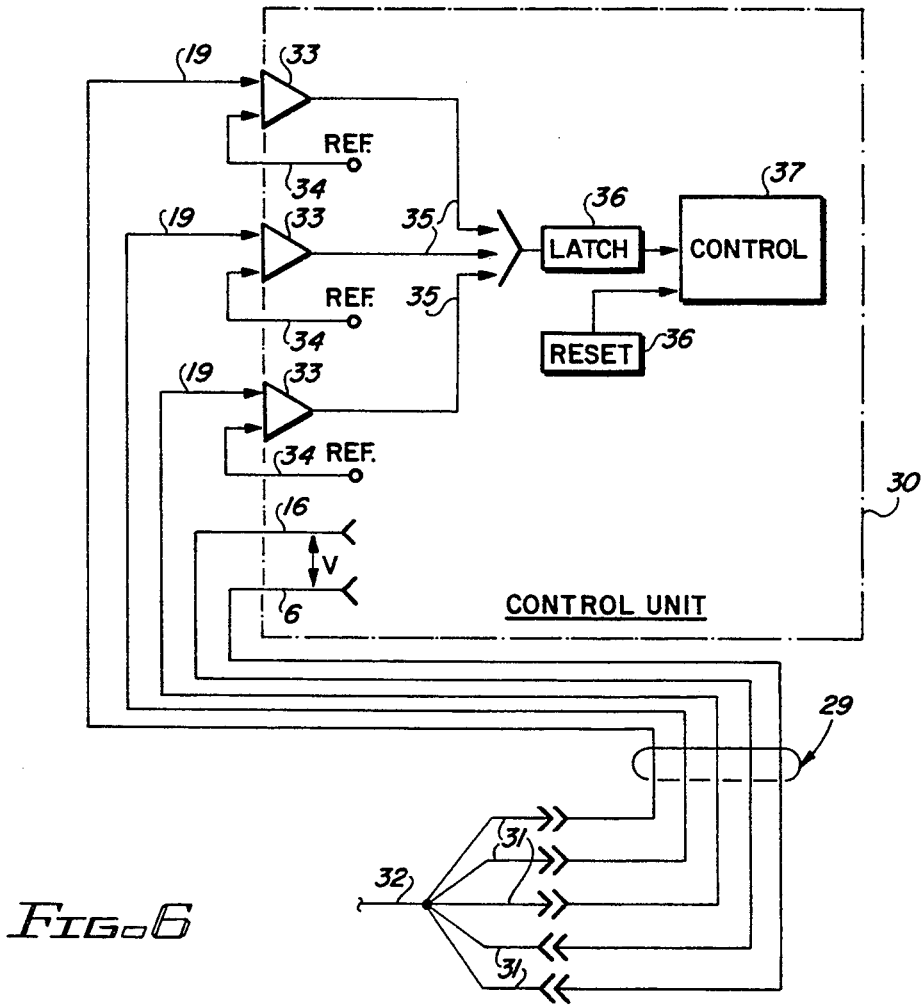
FIG. 6 is a schematic of a typical control unit circuit.
Figure 7:
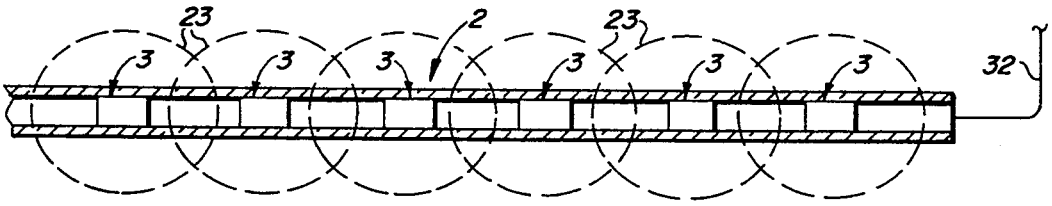
FIG. 7 is a sectional view of the enhanced sensitivity "Hall Effect" IC threshold detection unit.

Referring now to FIGS. 3, 5 and 7 of the drawings, the threshold detection unit 2 is further characterized by six detector boards 3, each of which includes an electronic circuit which is designed to enhance the existing characteristics of a pair of "Hall Effect" IC sensors. Accordingly, as illustrated in FIG. 5, a face-down "Hall Effect" sensor 4 is positioned on the detector board 3 adjacent to a face-up "Hall Effect" sensor 5 to enhance the characteristics of both the face-down "Hall Effect" sensor 4 and face-up "Hall Effect" sensor 5, as hereinafter described. It is understood that while the face-down "Hall Effect" sensor 4 and face-up "Hall Effect" sensor 5 are illustrated for brevity with the flat faces in facing relationship, these faces are actually oriented in parallel planes. Ground wiring 6 extends from the negative terminals of the face-down "Hall Effect" sensor 4 and face-up "Hall Effect" sensor 5 and to ground 7, as illustrated in FIG. 5. The face-down "Hall Effect" sensor output 8 projects from the output terminal of the face-down "Hall Effect" sensor 4 and is connected to resistor R-1, typically a 3.3K resistor, and to the negative stage 1 input 10 of a stage 1 buffer amplifier 12. Similarly, the face-up "Hall Effect" sensor output 9 extends from the output terminal of the face-up "Hall Effect" sensor 5 to resistor R-2, another 3.3K resistor, and terminates at the positive stage 1 input 11 of the stage 1 buffer amplifier 12. The negative stage 1 input 10 also extends to a 47K resistor R-3, which acts as a gain control resistor, and terminates at a stage 1 buffer amplifier output 13. Ground wiring 6 extends from a 100K resistor R4, to a ground 7. The stage 1 buffer amplifier output 13 further connects to the positive terminal of the 1 micro-farad tantalum electrolytic capacitor C-1 and the capacitor C-1 output 14 extends to a 200K resistor R-5 and also connects to a negative stage 2 input 15. Ground wiring 6 extends from a 200K resistor R-6 to ground 7. The capacitor C-1 output is also connected to the variable resistor R-5 as a part of a one megohm potentiometer circuit and ground wiring 6 projects from the variable resistor R-5 to ground 7. A potentiometer wiper 18 slidably engages the variable resistor R-5 and is connected to the positive stage 2 input of a stage 2 comparator 17. The potentiometer wiper 18 is adjusted during calibration and the negative stage 2 input 15 of the stage 2 comparator 17 is connected to the 1 microfarad tantalum electrolytic capacitor C-1 output 14, as heretofore described. The stage 2 comparator output 19 is connected to circuit components in a control unit 30, illustrated in FIGS. 1 and 6, as hereinafter described. The input of a 22 micro-farad tantalum electrolytic capacitor C-2 is also connected to the potentiometer wiper 18 and ground wiring 6 projects from the output or negative side of the capacitor C-2, to ground 7. Voltage supply lines 16 are connected to the face-down "Hall Effect" sensor 4, face-up "Hall Effect" sensor 5 and simultaneously powers the stage 1 buffer amplifier 12 and stage 2 comparator 17, as further illustrated in FIG. 5. Accordingly, referring again to FIGS. 3, 4 and 7 of the drawings, the face-down "Hall Effect" sensor 4 and face-up "Hall Effect" sensor 5 operate in the detector boards 3 to produce an enhanced detection zone 23, which is illustrated by the phantom circles. Under ordinary circumstances, as heretofore described, the conventional "Hall Effect" IC sensors produce an extremely small detection zone which would be inoperative to achieve the objectives of this invention. However, coupling the face-down "Hall Effect" sensor 4 and face-up "Hall Effect" sensor 5 together in the manner detailed in the circuit and described above, in the detector boards 3 illustrated in FIG. 5, together with other aspects of the invention as hereinafter described, enhances the detection zone 23, such that the detection zone 23 extends upwardly from the spaced detector boards 3 located in the threshold detection unit 2 about 8–10 inches, for purposes which will be hereinafter further described.

When configured as illustrated in FIG. 5, the stage 1 buffer amplifier 12 functions as a differential amplifier. When one of the face-down "Hall Effect" sensor 4 outputs responds to a magnetic field change by slightly altering its output voltage in a positive direction, the face-up "Hall Effect" sensor 5 will respond in the same magnitude, but in the opposite, or negative direction. While each sensor can be caused to go positive or negative, depending upon the characteristics of the magnetic field, the other sensor will always go in the opposite direction. This condition results from the physical manner in which the face-down "Hall Effect" sensor 4 and face-up "Hall Effect" sensor 5 are connected and the method of connection is often called a "push-pull" arrangement. The advantage of this connection in this regard is that the difference between the two sensor outputs is twice as large as the output which would be attainable from a single sensor. For these extremely small sensor outputs to be subsequently utilized they must be processed through or conditioned by a buffer-/amplifier stage. The stage 1 buffer/amplifier 12 is configured as a differential amplifier, which means that the stage 1 buffer/amplifier 12 will amplify the difference between the inputs supplied to it. It also means that loading effects on the stage 1 output will be "buffered" from the input circuit (i.e. the sensitivity of the input circuit will not be adversely effected by changes which occur in the output circuit).

The output of the stage 1 buffer/amplifier 12 is a DC level with small random AC variations (noise) superimposed on the DC level. This AC component is AC "coupled" through the 1 micro-farad tantalum electrolytic capacitor C-1 from the capacitor C1 output 14 to the junction of resistors R-5 and R-6 and the negative stage 2 input 15 of the stage 2 comparator 17 the capacitor C-1 will pass both the high frequency random noise, as well as the desired low frequency signals, which result when a strong magnet sweeps through the detection zone of the sensors.

In the absence of a magnetic field caused by the magnetic anklet assembly 25, the random high frequency noise which always exists at the output of the stage 1 buffer/amplifier 12 are AC coupled through the resistance/capacitance combinations of the capacitor C-1, resistor R-5 and capacitor C-2 and will accumulate on the capacitor C-2, causing a build-up or "charge" to accumulate. It is intended that this voltage level (after initial calibration) will average about 4 mv above the voltage on the negative stage input 15. Since the voltage level on capacitor C-2 is only slightly higher than on the negative stage input 15, this condition keeps the stage 2 comparator output 19 from "switching" to an alarm state. Since both of the stage 2 comparator inputs 5 are derived from the identical source (the negative side of the capacitor C-1) then problems normally associated with noise, drift and false alarms are eliminated. Accordingly, this design insures that the system is self-compensating and capable of detecting signals in the range of four to six mv.

The output from the stage 2 of each of the detection boards is a fixed voltage so long as an alarm condition does not exist. This voltage need not be steady, but may vary or drift slightly. For example, if this voltage is 11.2 volts, plus or minus 0.2 volts, when the alarm condition occurs, the voltage momentarily drops, because the stage 2 comparator output 19 is switched from a high, or "no alarm" state, to a relatively love, or "alarm" state, by more than one volt. Therefore, when the output signal from the stage 2 comparator 11 momentarily drops below the fixed reference level at the reference voltage lines 34, for example, 10.5 volts, of the control units' input comparators 33, then this output comparator output 35 will drop, causing a standard "latching" circuit 36 to hold this output at a low level, as illustrated in FIG. 6. This low level will activate the alarm control 37 and the visual and/or audible alarms 38. Human intervention is then required to reset the system to its normal operational mode. The control unit also contains a system power supply (12 volts DC) and in all other respects includes standard conventional circuitry.

Accordingly, a sample is continuously taken from the variable input which occurs at point B, illustrated in FIG. 5, and stabilized as a quasi or phantom reference at point D. This occurs because the slow drifting on the variable input is transferred to the point D input. Consequently, the point D is forced to "track" the variable input at point B and, in a practical sense, the voltage difference between the two inputs at points B and D can be held relatively constant. This arrangement produces an extremely positive benefit in the overall operation of the detector board 3 illustrated in FIG. 5. The other half of this arrangement is the fact that a very small change in the signal at the selected point B can cause different effects on the inputs at selected points C and D if the intervening resistor/capacitor (RC) combinations are properly selected, such that a small change at point B would be instantly sensed at point C, but will not be instantly sensed at point D, because point D has large RC series values that, in themselves, tend to absorb this change. Therefore, since the signal at point B can increase, then the input at point C will instantly "see" this increase, but the input at point D, because of its RC combination, will not immediately increase. Therefore, the comparator can be caused to change its output state based on the increase in value at point C while point D appears constant.

Referring now to FIGS. 1–4, a magnetic ankle assembly 25 characterizes the second element of the selective exit control system 1 and is designed to operate in cooperation with the threshold detection unit 2 to achieve the purposes of this invention. The magnetic ankle assembly 25 includes a magnetic carrier 26, fitted with spaced carrier slots 26*a*, for accommodating a carrier strap 27 having a strap tab 27*a*. A pair of strong rare earth magnets 28 are disposed in parallel, spaced relationship in separate magnet pouches 29 in the magnetic carrier 26, such that the magnetic pouches 29 and magnets 28 lie on either side of the achilles tendon, above the heel of the leg 42 of the person 41, as further illustrated in FIGS. 3 and 4. The magnets are designed and strategically oriented to simultaneously increase and broaden the magnetic e field strength in a preferred direction, in this case, downwardly, in order to sound an alarm when the magnets 28 are carried through detection zone 23 created by the threshold detection unit 2, as illustrated in FIGS. 3, 4 and 7 and as hereinafter further described. In a most preferred embodiment of the invention the magnetic ankle assembly 25 is designed to be non-removably attached to the ankle of the leg 42 to prevent unauthorized removal by the patient of a hospital or resident of a nursing home, as the case may be. Accordingly, the carrier strap 27 and strap tab 27*a* of the magnetic carrier 25 may be designed in a variety of configurations to facilitate such a permanent, yet comfortable fit, according to the knowledge of those skilled in the art. For example, the carrier strap 27 and strap tab 27*a* may be connected by rivets, in the same manner as hospital identification bands, as desired.

Referring now to FIGS. 1, 5 and 6 of the drawings, a wiring cable 32 engages cable leads 31 and connects each of the spaced detector boards 3 in the threshold detection unit 2 to the control unit 30 which is mounted on the wall 45 of a structure adjacent to the doorway 43, as illustrated in FIG. 1. In a preferred embodiment of the invention the control unit 30 is conventional in design and contains a circuit such as the circuit illustrated in FIG. 6 and contained within the dotted lines therein. For example, and as heretofore described, the control unit 30 typically contains three input comparators 33 which are connected to the stage 2 comparator output 19, illustrated in FIG. 5, and each serve two of the detector boards 3 and include a reference voltage line 34. Ground wiring 6 is also provided for grounding the detector boards 3, while the voltage supply line 16 supplies power to the threshold detection unit 2, as illustrated. The outputs of each of the input comparators 33 are typically connected to a latching circuit 36 of suitable design by means of input comparator output lines 35 and the latching circuit 36 is coupled to an alarm control 37 and one or more alarms 38, having a reset 39 which requires human intervention to reset after the alarm(s) 38 are activated. It will be appreciated by those skilled in the art that the control unit 30 is conventional in design and may be designed in a number of different configurations, according to the knowledge of those skilled in the art. The primary purpose of the control unit 30 is to provide either visual or audible alarms and preferably, both, which the alarm(s) 38 is intended to encompass, further according to the knowledge of those skilled in the art.

Accordingly, referring again to the drawings, under circumstances where the patient of a hospital or resident of a nursing home or other controlled area is fitted with a magnetic anklet assembly 25 and the doorway 43 or other monitored area is provided with a threshold detection unit 2, movement of the leg 42 of the person 41 over the threshold detection unit 2 causes the alarm or alarms 38 illustrated in FIG. 6 to go off. The alarm(s) 38 are triggered by the swinging of tile leg 42 of the person 41 and the magnetic anklet assembly 25 through the detection zone 23 produced by the threshold detection unit 2, wherein the detector boards 3 detect the magnetic field of the magnets 28 and activate the alarm(s) 38 by operation of the circuitry illustrated in FIGS. 5 and 6. Since the selective exit control system 1 of this invention is designed primarily to contain persons having various dementia, it is unlikely that these persons will attempt to defeat the selective exit control system 1 by stepping over the detection zone 23. Accordingly, the selective exit control system 1 operates to reliably determine when such a person wearing a magnetic anklet assembly 25 is stepping through a controlled doorway 43 or other area which is protected by the threshold detection unit 2. Since the detection zone 23 extends upwardly some 8–10 inches above the threshold cover 21, this distance is well within the normal ankle swing of the person 41 walking through the doorway 43 and therefore insures that the alarm(s) 38 will be triggered by operation of the magnets 28.

It will be appreciated from a consideration of the selective exit control system 1 of this invention that the threshold detection unit 2 and magnetic anklet assembly 25 can be used in combination for a variety of control purposes on patients in hospitals and in other control circumstances other than exiting a structure or controlled area. For example, the magnetic carrier 26 can be attached to the ankle of a hospital patient and the threshold detection unit 2 placed in the area of the hospital bed to prevent unauthorized exit from the bed without the use of restraints. Other uses, including perimeter control and the like, may be envisioned by those skilled in the art.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A selective exit control system for determining when a selected person exits a controlled area, comprising an anklet adapted for attachment to the ankle of the selected person and at least one magnet having a selected flux provided in said anklet;

a magnetic detection integrated circuit having at least one "Hall Effect" integrated circuit sensor for generating a detection field having first predetermined magnetic wave-shape characteristics, said detection field taking on second predetermined magnetic wave-shape characteristics when said anklet is present in the detection field, said at least one sensor further receiving the detection field and providing a sensor signal having first predetermined signal characteristics when said anklet is present in the detection field and second predetermined signal characteristics when said anklet is not present in the detection field;

buffer/amplifier circuit means connected to said at least one "Hall Effect" integrated circuit sensor for amplifying the signal characteristics of the sensor signal; and alarm means connected to said magnetic detection integrated circuit and responsive to said buffer/amplifier circuit means amplifying said first predetermined signal characteristics of the sensor signal to provide an alarm signal;

whereby movement of the selected person through said detection field while wearing said anklet actuates said alarm means.

2. The selective exit control system of claim 1 wherein said detection field is generated in a doorway leading to the controlled area.

3. The selective exit control system of claim 1 further comprising cover means located in a doorway and wherein said magnetic detection integrated circuit is covered by said cover means.

4. The selective exit control system of claim 1 further comprising a cover located in a doorway threshold leading to the controlled area and wherein said detection field is generated in said doorway threshold leading to the controlled area by said magnetic detection integrated circuit contained in said cover.

5. The selective exit control system of claim 1 wherein said at least one magnet further comprises a pair of magnets disposed in said anklet in spaced relationship and said detection field is generated in said controlled area by said magnetic detection integrated circuit.

6. The selective exit control system of claim 1 wherein said anklet is secured to the ankle of the selected person in non-removable relationship and said at least one magnet comprises a pair of magnets oriented side by side and adjacent to each other and to the ankle of the selected person.

7. The selective exit control system of claim 6 further comprising a cover located in a doorway and wherein said detection field is generated in the doorway by said magnetic detection integrated circuit contained in said cover.

8. The selective exit control system of claim 1 wherein said alarm means comprises an audible alarm.

9. The selective exit control system of claim 1 wherein said alarm means comprises a visual alarm.

10. The selective exit control system of claim 1 wherein said alarm means comprises an audible alarm and a visual alarm.

11. The selective exit control system of claim 10 wherein said detection field is generated in a doorway leading to the controlled area.

12. The selective exit control system of claim 11 further comprising a cover located in said doorway and wherein said magnetic detection integrated circuit is contained in said cover.

13. The selective exit control system of claim 12 wherein said anklet is secured to the ankle of the selected person in non-removable relationship and said at least one magnet comprises a pair of magnets oriented side by side and adjacent to each other and to the ankle of the selected person.

14. A selective exit control system for determining when a selected person exits a controlled area, comprising:

magnetic assembly means attached to the ankle of the selected person;

a plurality of "Hall Effect" integrated circuits disposed in a selected configuration, each of said "Hall Effect" sensors integrated circuits characterized by a pair of "Hall Effect" arranged in face-to-face relationship for generating a detection field having first predetermined magnetic wave-shape characteristics, each said detection field taking on second predetermined magnetic wave-shape characteristics when said magnetic assembly means is present in the detection field, each said pair of "Hall Effect" sensors further receiving a corresponding detection field and providing a sensor signal having first predetermined signal characteristics when said magnetic assembly means is present in the detection field and second predetermined signal characteristics when said magnetic assembly means is not present in the detection field;

a buffer/amplifier circuit having a differential amplifier connected to each of said "Hall Effect" integrated circuits for amplifying, by a magnitude of at least eight, the signal characteristics of each sensor signal; and alarm means connected to said "Hall Effect" integrated circuits and responsive to said buffer/amplifier circuit amplifying said first predetermined signal characteristics of any of said sensor signals to provide an alarm signal;

whereby movement of the selected person through said detection field while wearing said magnetic assembly means actuates said alarm means.

15. The selective exit control system of claim 14 wherein said magnetic assembly means further comprises a magnetic carrier and a pair of rare earth magnets disposed in said magnetic carrier in side by side and adjacent relationship.

16. The selective exit control system of claim 15 wherein said alarm means comprises both an audible alarm and a visual alarm.

* * * * *